United States Patent [19]

Hsia

[11] Patent Number: 4,736,526

[45] Date of Patent: Apr. 12, 1988

[54] GEOMETRY TEMPLATE

[76] Inventor: Eric Hsia, 132 S. Telegraph Hill Rd., Holmdel, N.J. 07733

[21] Appl. No.: 40,258

[22] Filed: Apr. 17, 1987

[51] Int. Cl.[4] ..... B43L 13/00; B43L 9/00

[52] U.S. Cl. ..... 33/565; 33/27.03

[58] Field of Search ..... 33/27.01, 27.02, 27.03, 33/465, 563, 565

[56] References Cited

U.S. PATENT DOCUMENTS

| | | | |
|---|---|---|---|
| 765,300 | 7/1904 | Williams | 33/27.03 |
| 824,299 | 6/1906 | Huey | 33/27.03 |
| 1,899,318 | 2/1933 | Dixon | 33/563 |
| 2,364,529 | 12/1944 | Hill | 33/565 |
| 2,487,673 | 11/1949 | Roper | 33/565 |
| 2,579,857 | 12/1951 | Premo | 33/565 |
| 2,612,690 | 10/1952 | Cotton | 33/27.03 |
| 3,096,586 | 7/1963 | Albright et al. | 33/465 |
| 3,119,188 | 1/1964 | Orndorff | 33/565 |
| 3,460,261 | 8/1969 | Frey | 33/27.03 |

FOREIGN PATENT DOCUMENTS

| | | | |
|---|---|---|---|
| 219676 | 2/1942 | Switzerland | 33/27.03 |

*Primary Examiner*—Richard R. Stearns

[57] ABSTRACT

Apparatus is disclosed in which a clear plastic template bears a combination of inscribed marks and aperatures adapted to cooperate with each other so as to enable a user to readily draw common geometric figures. The template further cooperates with an annexed arm which rotates with respect to the template to assist in drawing circles.

10 Claims, 1 Drawing Sheet

GEOMETRY TEMPLATE

BACKGROUND OF THE INVENTION

1. Field of the Invention

The invention relates to drafting instruments and pertains to templates which assist a draftsman in drawing common geometric shapes.

2. Description of the Prior Art

Drafting templates are commonly available for many drafting applications. For example, many devices are available to form circles, while other bear complicated apertures for creating linear geometric forms. Finally, some combine both functions into a single device. All function adequately but are usually mechanically complex in construction or have been relatively limited in their use due to structural design.

Accordingly, one object of this invention is to achieve a device which facilitates the drawings of both linear and circular forms in a unitary design which is mechanically simple and easy to use.

SUMMARY OF THE INVENTION

In accordance with the preferred embodiment of the invention, a clear plastic template cooperates with indicia marked on its surface and a rotating member attached to the template to facilitate drawing of a variety of linear and circular geometric forms.

In accordance with an important feature of the invention, the plastic template is rectilinear and perforated by a variety of geometric openings, the indicia marked on the surface of the template are juxtaposed around the openings to facilitate the drawing of linear forms and the rotating member comprises at least one arm having a row of apertures extending along its long axis.

A better understanding of these and other objects and features will be facilitated by reference to the following description of the drawing and detail description of the invention.

BRIEF DESCRIPTION OF THE INVENTION

FIG. 1 is a front elevation view of the overall structure of the invention.

DETAILED DESCRIPTION OF THE INVENTION

Figure 1:
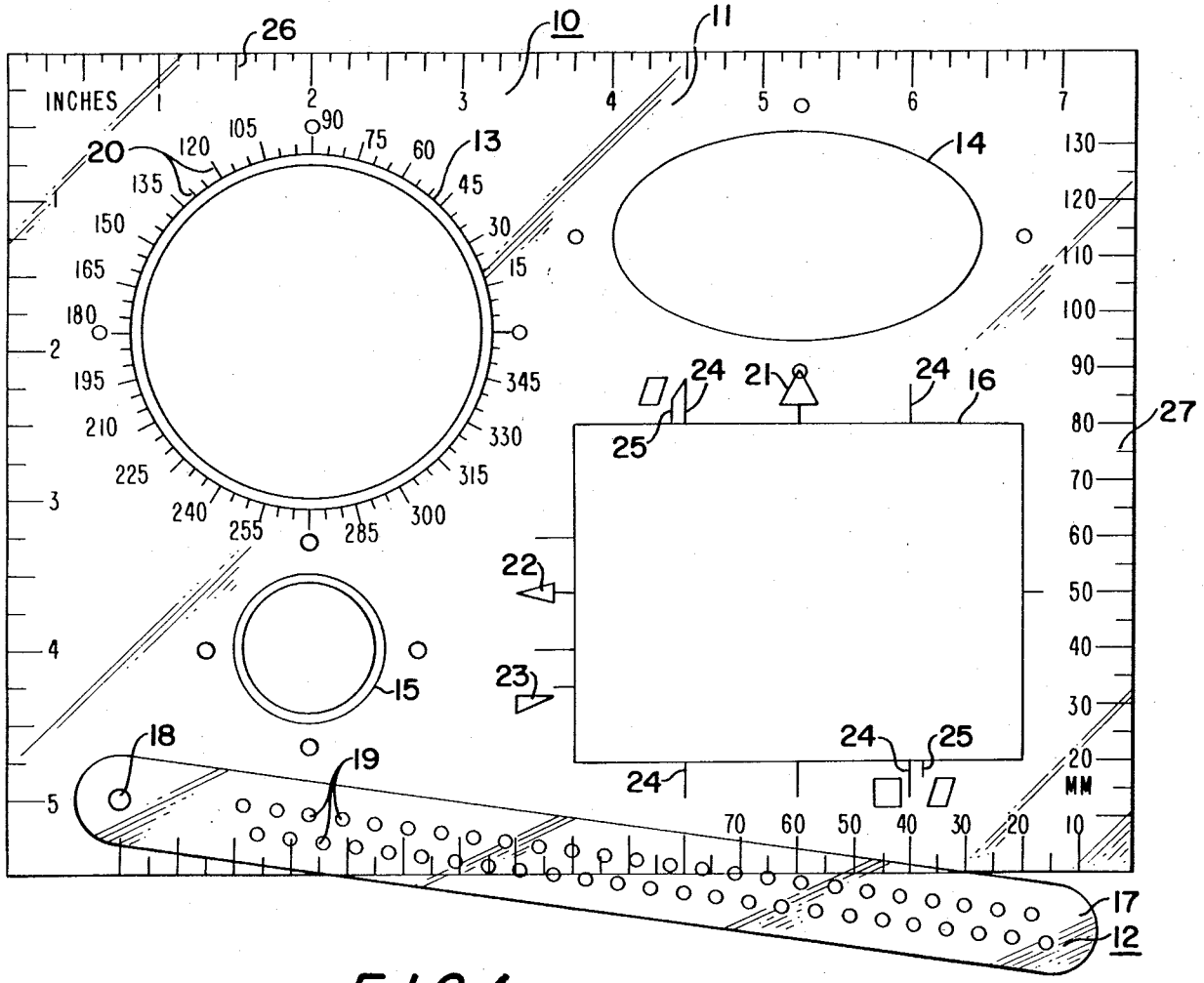

Referring to FIG. 1, a template assembly 10 is disclosed which comprises a template 11, a pivot assembly 12 and a plurality of openings defined by edges 13, 14, 15 and 16.

The pivot assembly 12 includes a flat elongated arm 17 which has a pivot 18 at one end and a number of openings 19 disbursed along its length. The pivot 18 joins the arm 17 in rotatable relationship to the template 11 and both the member 17 and the template 11 are made of a clear plastic. The openings 19 are advantageously dispersed in even increments along the length of the arm 17 and function to subscribe a circle when the pivot 18 is held fixed and the point of a drawing instrument is projected through a selected opening, pressed against the drawing surface and the arm 17 rotated.

In the embodiment disclosed, the openings 19 are staggered and arranged in two parallel rows to permit fine differences in subscribed circles. Moreover, the arm 17 is attached at one corner of the template 11. The specific location is a matter of choice and, in fact, a template 11 without an arm 17 or with multiple arms 17 is also contemplated.

As shown in FIG. 1, the edges 13, 14, 15 and 16 in the template 11 define various geometric shapes. In the embodiment illustrated, the edge 13 defines a circular opening, the edge 14 defines and oval opening, the edge 15 defines a small circular opening in relation to the one defined by the edge 13 and the edge 16 defines a rectilinear opening. Moreover, the edge 13 is marked with indicia 20 evenly distributed to define a 360 degree protractor. As illustrated in the circular opening defined by the edge 13, the indicia 20 in cooperation with the opening allow a user to readily create any desired angle.

Similarly, the edges 14 and 15 allow a user to readily create circles and ellipses where desired. In addition, the edge 16 is marked by several kinds of indicia 21, 22, 23, 24 and 25 to permit ready creation of various rectilinear or triangular shapes. For example, as shown in FIG. 1, the indicia 21, 22 and 23 readily permit the user to construct equilateral, isosceles and 30:60:90 degree triangles, respectively. In a like manner, by using the indicia 24 and 25, the user can easily construct a square or rhombus, respectively.

Finally, indicia 26 and 27 are inscribed along the edges of the template 11. As shown in FIG. 1, the indicia 26 are distributed along adjacent edges of the template 11 and are arranged to display English linear dimensions while the indicia 27 display metric dimensions and are distributed along adjacent edges opposite to the edges bearing the indicia 26. By doing so, the edges serve as ready and convenient rules. At the same time, however, they can cooperate to facilitate construction of triangular and other geometric shapes by the user.

In summary, a new novel template has been disclosed and described in which a clear plastic template bears a combination of inscribed marks and apertures adapted to cooperate with each other so as to enable a user to readily draw common geometric figures. The template further cooperates with an annexed arm which rotates with respect to the template to assist in drawing circles. The result is a simple, easy to use drafting tool. While only one embodiment of the invention has been disclosed, it is merely representative of the principals of the invention and it is anticipated and expected that those skilled in the art will readily recognize and utilize other embodiments falling within the scope of the invention.

What I claim is:

1. In a template assembly for drawing geometric designs, the combination comprising:

a thin, rectilinear transparent plate having a plurality of internal edges, a plurality of apertures defined by said edges to form multiple geometrical shapes, two of said shapes being a large and small circle respectively, one shape being an oval and one shape being a rectangle, an elongated arm attached to said plate at one end so as to pivot, and a plurality of varigated indicia distributed around the perimeter of said plate, around the edges of said large circle aperture and around said rectangle aperture to facilitate the drawing of geometric forms.

2. The combination in accordance with claim 1 wherein the indicia surrounding the edges of said large circle aperture is subscribed on the surface of said plate and is graduated to define a protractor having 360 degrees.

3. The combination in accordance with claim 1 wherein the indicia distributed around the perimeter of said plate is subscribed on the surface of said plate and defines linear measurements.

4. The combination in accordance with claim 1 wherein the indicia surrounding said rectangular aperture is subscribed on the surface of said plate and is graduated to facilitate drawing of a square, a rectangle, a rhombus, a parallelgram, an equilateral triangle, an isoceles triangle, a 45:45:90 degree right triangle, a 3:4:5 proportion right triangle and 30:60:90 degree right triangle, respectively.

5. The combination in accordance with claim 1 wherein the indicia surrounding the edges of said large circle aperature is subscribed on the surface of said plate and is graduated to define a protractor having 360 degrees, the indicia distributed around the perimeter of said plate is subscribed on the surface of said plate and defines linear measurements and the indicia surrounding said rectangular aperture is subscribed on the surface of said plate and is graduated to facilitate drawing of a square, a rectangle, a rhombus, a parallelogram, an equilateral triangle, an isoceles triangle, a 45:45:90 degree right triangle, a 3:4:5 proportion right triangle and 30:60:90 degree right triangle, respectively.

6. The combination in accordance with claim 5 wherein the indicia graduated to facilitate drawing of a square comprises two pairs of a set of aligned linear marks oppositely disposed to each other and located orthogonally to the edge of said rectangular aperture.

7. The combination in accordance with claim 5 wherein the indicia graduated to facilitate drawing of a rhombus comprises two non-aligned linear marks disposed on opposite portions of the edge of said rectangular aperture.

8. The combination in accordance with claim 5 wherein the indicia graduated to facilitate drawing of an isosceles triangle comprises a triangle located adjacent to the center of a portion of a long edge of said rectangular aperture.

9. The combination in accordance with claim 5 wherein the indicia graduated to facilitate drawing of a 30:60:90 degree triangle comprises a triangle located adjacent to one end of a portion of a short edge of said rectangular aperture.

10. The combination in accordance with claim 5 wherein the indicia graduated to facilitate drawing of an isosceles triangle comprises a triangle located adjacent to the mid-point of a portion of a short edge of said rectangular aperture.

* * * * *